US005269033A

United States Patent [19]

Reid et al.

[11] Patent Number: 5,269,033

[45] Date of Patent: Dec. 14, 1993

[54] BEACH TOWEL WITH SUN REGULATING MEANS

[76] Inventors: William E. Reid; Constance A. Reid, both of 18 Leah St., North Providence, R.I. 02911

[21] Appl. No.: 941,488

[22] Filed: Sep. 8, 1992

[51] Int. Cl.[5] ..... A47G 9/08

[52] U.S. Cl. ..... 5/417; 5/462; 5/420; 368/10

[58] Field of Search ..... 5/417-420, 5/462, 482, 485, 639; 128/362, 372, 376; 368/10, 12

[56] References Cited

U.S. PATENT DOCUMENTS

| | | | |
|---|---|---|---|
| 4,093,944 | 6/1978 | Muncharyau | 368/12 X |
| 4,468,823 | 9/1984 | Tounjian | 5/417 |
| 4,841,587 | 6/1989 | Carter et al. | 5/419 |
| 4,914,767 | 4/1990 | Balicki et al. | 5/417 X |
| 5,072,429 | 12/1991 | Mair | 5/904 X |
| 5,076,405 | 12/1991 | Modica | 5/417 X |
| 5,097,549 | 3/1992 | Swing | 5/417 |
| 5,144,600 | 9/1992 | Cheng | 368/10 X |

*Primary Examiner*—Michael F. Trettel
*Attorney, Agent, or Firm*—Robert J. Doherty

[57] ABSTRACT

A sunbathing device comprising a sheet generally in the form of a large beach towel in which the upper surface thereof is provided with means for dividing such surface into segments. The sheet additionally includes a timing device whereby a periodic signal is given to the user of the device such that he or she may shift to an adjacent area segment of the sheet to evenly expose one's body to the sun's rays or to terminate such exposure.

9 Claims, 1 Drawing Sheet

BEACH TOWEL WITH SUN REGULATING MEANS

BACKGROUND AND OBJECTS OF THE INVENTION

This invention relates to a beach towel and more particularly to an improved beach towel which includes means for both orienting the towel with respect to some fixed geographical point and means for regulating the amount and direction of sun one receives from utilizing such towel. Since the term "towel" is believed to be specific to a fabric-type material which is useful for absorbing moisture in addition to lying upon, the present invention is referred to as a device wherein a portion of such device includes the planar sheet whether such sheet is a fabric towel or made from any other suitable material such that it can suit the purposes of this invention as by providing an appropriate surface to be placed upon the beach or other surface on which the sun bather or person engaged in other timed activity may rest.

A recurrent problem in sun bathing is that different parts of one's body are exposed to the sun's rays for different amounts of time and, accordingly, either results in an uneven tan or undesirable overexposure of certain body parts. In other words during sunbathing or beach activities, it is common to lay upon a blanket or beach towel and inadvertently maintain either by falling asleep, dozing or attention to other activities, orientate one's body in the same or limited positions for an extensive time period. Additionally with the increased awareness of medical damage that can be caused by overexposure to the sun's rays, it would be desirable to provide some means by which the amount of time one is exposed thereto can be more regulated.

Accordingly, it is an overall object of the present invention to provide a device in the form of a sheet such as a towel, blanket or other appropriate surface such that the person sunbathing may orientate himself or herself in a particular fashion with respect to the surface and be periodically warned by a timing device that it is time to re-orientate one's position vis-a-vis the sheet and thus the sun.

An additional object of the present invention is the provision of a sunbathing device which additionally includes means by which a portion of the sheet thereof can be orientated with respect to some geographical point such as the edge of the beach and the like to insure the sheet remains in a fixed position and that periodic movement with respect thereto results in the desired re-orientation with respect to the sun.

These and other objects of the present invention are accomplished by a sunbathing device comprising a planar sheet having opposed upper and lower surfaces and having a generally regular geometric periphery, said upper surface including a plurality of lines extending from opposed points on said periphery across said sheet so as to divide said sheet upper surface into a plurality of area segments which are radially adjacent to each other, means provided on said upper surface for orienting said sheet with respect to a known geographical reference point and a periodic timer in turn having an alarm fixedly attached to said sheet whereby a person lying on one of said area segments is signaled by said timer to move to another segment so as to regulate sun exposure.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
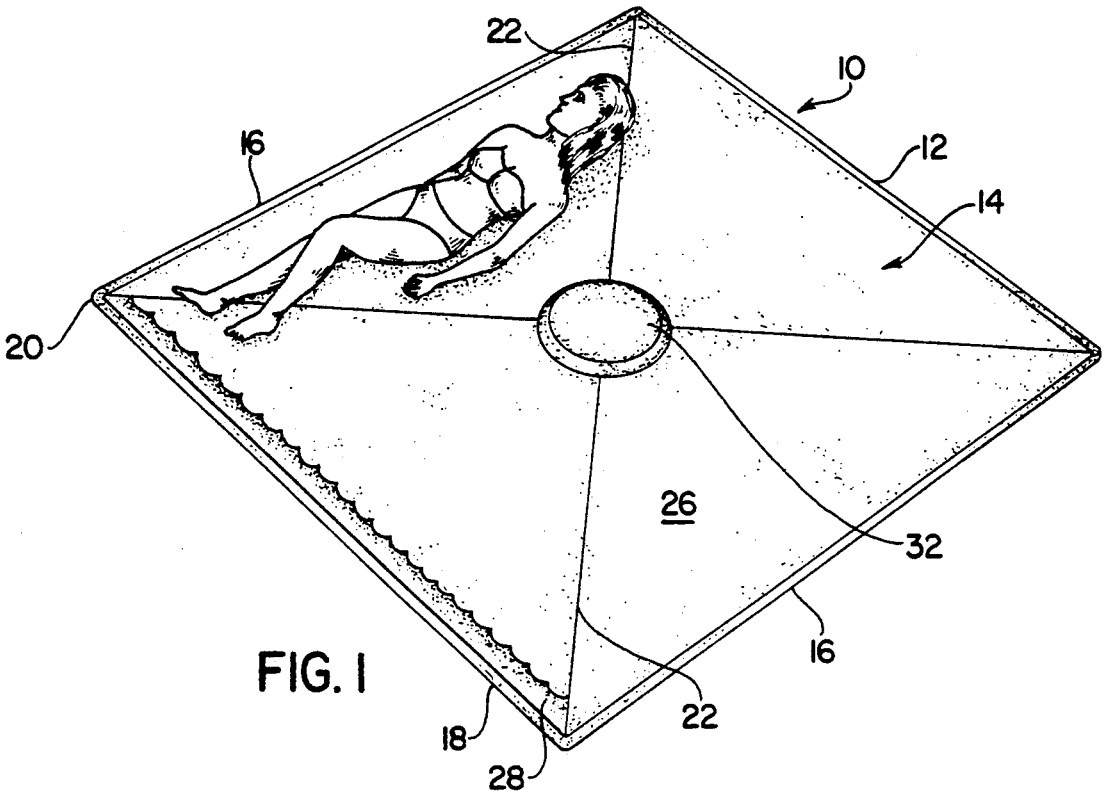
FIG. 1 is a top perspective view showing the device of the present invention in use as upon a beach, lawn, etc.
Figure 2:
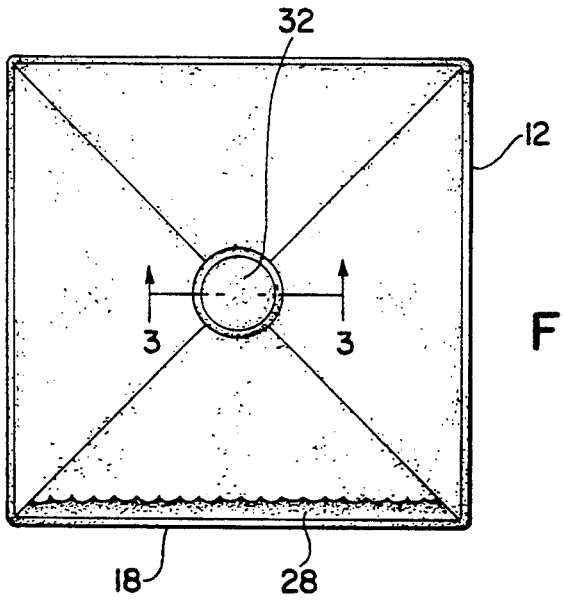
FIG. 2 is a top plan view thereof.
Figure 3:
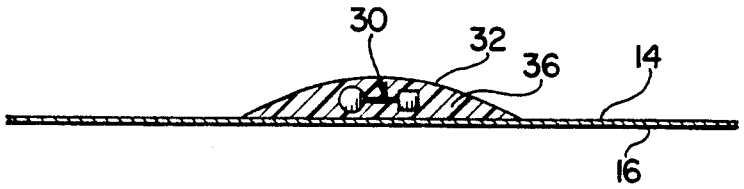
FIG. 3 is a sectional view on an enlarged scale through the line 3—3 of FIG. 2.

Referring to the drawings and particularly FIGS. 1 and 2 thereof, the device 10 of the present invention includes a sheet 12 having an upper surface 14 and a lower surface 16. Generally the sheet 12 is a large rectangular beach towel, e.g., a square towel measuring 7'×7', and having a pair of opposed side edges 16, a lower edge 18, and an upper edge 20. Although continued description of the invention will be made with reference to a square sheet 12, it should be pointed out that other geometric sheet forms may be utilized, for instance, unequal side rectangles, hexagons or even circles. In other words, so long as the sheet can perform the attributes of the present invention which will later be delineated, it can be of any configuration although preferably such configuration should be that of a standard geometric form so as to lend itself to being divided into a plurality of generally equal segments over the upper surface 14 thereof for a purpose which will hereinafter be more fully explained. Furthermore, the sheet 12 may be formed of any convenient material including towel material such as terry cloth, blanket-type material, resinous plastic material or even paperboard or the like.

In the sheet 12 configuration shown in the drawings, diagonally-opposite corners 20 are connected by means of lines 22 which in turn crisscross in the center 24 of the sheet and, accordingly, form four equally-sized area segments 26. The lines 22 may be formed in a variety of ways other than by printing or pointing as contemplated in the drawings including the attachment of contrasting colored material strips as by adhesive, sewing or the like or by providing lines of a different thickness than the surrounding segment 26 areas and in this way also be tactility distinguishable as well as visible.

Of course, it should be brought out that if a non-square rectangle is utilized or some other geometric shape is utilized, the area segments 26, which are in all cases radially adjacent each other, may or may not be of equal area. One of the edges of the sheet 12 and preferably the lower edge 18 is provided with an orienting line or strip of indicia 28 such that the edge may be more visably oriented parallel to some geographical reference point such as the beach shoreline so that the sheet 12 tends to stay in a semi-permanent location, and the person utilizing the device moves with respect to the sheet 12 rather than vice versa. In the case depicted, the line 28 is in the form of printed indicia simulating the crest of waves for decorative and reminder purposes.

The center 24 of the sheet 12 is provided with a timer 30 which is fixedly attached to the sheet 12 or permanently embedded therein. A suitable mechanism for attaching the timer to the sheet 12 would be by cutting a hole in the sheet center 24 and thereafter placing a timer having a flange and mount ring therein much in the manner as shown by U.S. Pat. No. 4,769,799, the disclosure of which is hereby incorporated hereinto by specific reference thereto. An additional manner of attaching the timer 30 to the sheet 12 would be as shown in the drawings wherein the central portion 24 is provided with a double thickness material, that is, the upper surface 14 includes a generally circular overlying flap 32 which can either be permanently or removably sealed to the adjacent portions of the upper surface 14. Generally the flap 32 is circular and is heat sealed at its periphery 34 or temporarily adhesively connected along such periphery to the underlying upper surfaces 14 of the sheet 12. In addition, the central portion 24 may be provided with a filling or cushioning material 36 to form, in effect, a pillow in the central portion 24 upon which the user of the device may rests his or her head or other body part as may be appropriate. This feature also may provide the timer with a measure of protection from being stepped or sat upon or potential harmful contact with beach accessories. It should be pointed out, however, that the primary reason for these means is to provide suitable attachment for the timer.

The timer 30 is preferably of the solar type which includes a timing circuit and an audible alarm, i.e., a beeper, which after a suitable time period, e.g., ten minutes, will sound for an appropriate length of time, e.g., five seconds. The timing circuit may also include an on-off switch, but solar activation is preferred. Accordingly, the flap or cover 32 is preferably transparent or at least semi-transparent such that sunlight may recharge the battery pack or other solar activation means. In this regard, the flap could include a transparent portion for this purpose. Such timer includes an integrated circuit, a power source, i.e., a solar activated battery, and a beeper. Such circuitry is conventionally available in alarm wrist watches and the like. This audible alarm will then alert the user to the fact that he or she has been exposed upon one of the segments 26 for a ten minute or other suitable time period, and that it is then suitable to move to an adjacent sheet 12 area segment. In this way then, the sun's rays are more equally distributed over the total area of a person's body as the user moves from area segment 26 to area segment during each of the incremental time periods. The alarm is referred to above as being audible, i.e., a beeper; and while this is the preferred form, the alarm could either alternatively or additionally take the form of a vibratory device, i.e., a buzzer, that the user can feel or sense rather than hear.

The timer 30 also can serve and does serve as a warning that the person has been exposed for a certain period of sun and that it may also be appropriate rather than move to the next adjacent area segment 26 to cover one's body or move to a shady location. In either operational manner, the device 10 of the present invention enables the objects of the invention to be accomplished in a flexible, useful and simple manner.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sunbathing device comprising a planar sheet having opposed upper and lower surfaces and having a generally regular geometric periphery, said upper surface including a plurality of lines extending from opposed points on said periphery across said sheet so as to divide said sheet upper surface into a plurality of area segments which are radially adjacent to each other, means provided on said upper surface for orienting said sheet with respect to a known geographical reference point and a periodic timer in turn having an alarm fixedly attached to said sheet whereby a person lying on one of said area segments is signaled by said timer to move to another segment so as to regulate sun exposure, said sheet being rectangular with said plurality of segment forming lines being two lines, each said line extending from diagonally opposite corners to crisscross in the center of the sheet so as to divide the sheet upper surface into four segments.

2. The device of claim 1, said means for orienting said sheet being a line separate from said segment forming lines positioned proximal one end of said rectangular sheet and extending laterally across said one end.

3. The device of claim 2, said timer positioned centrally of said sheet and accessible to said person from the upper sheet surface.

4. The device of claim 3, said sheet being a fabric beach towel.

5. The device of claim 3, said timer permanently attached to said sheet.

6. The device of claim 5, said sheet including separate material layers where said timer is centrally positioned, said layers including means for padding said central position so as to provide a pillow for said person lying on said sheet upper surface.

7. A sunbathing device comprising a planar sheet having opposed upper and lower surfaces and having a generally regular geometric periphery, said upper surface including a plurality of lines extending from opposed points on said periphery across said sheet so as to divide said sheet upper surface into a plurality of area segments which are radially adjacent to each other, means provided on said upper surface for orienting said sheet with respect to a known geographical reference point and a periodic timer in turn having an alarm fixedly attached to said sheet whereby a person lying on one of said area segments is signaled by said timer to move to another segment so as to regulate sun exposure, said means for orienting said sheet being a line separate from said segment forming lines positioned and laterally extending across said sheet proximal a peripheral portion thereof.

8. A sunbathing device comprising a planar sheet having opposed upper and lower surfaces and having a generally regular geometric periphery, said upper surface including a plurality of lines extending from opposed points on said periphery across said sheet so as to divide said sheet upper surface into a plurality of area segments which are radially adjacent to each other, means provided on said upper surface for orienting said sheet with respect to a known geographical reference point and a periodic timer in turn having an alarm fixedly attached to said sheet whereby a person lying on one of said area segments is signaled by said timer to move to another segment so as to regulate sun exposure, said timer positioned centrally of said sheet and accessible to said person from the upper sheet surface, said timer permanently attached to said sheet.

9. The device of claim 8, said sheet including separate material layers where said timer is centrally positioned, said layers including means for padding said central position so as to provide a pillow for said person lying on said sheet upper surface.

* * * * *